United States Patent [19]

Chiesa, Jr.

[11] 3,957,657

[45] May 18, 1976

[54] FIRE FIGHTING

[75] Inventor: Peter J. Chiesa, Jr., Coatesville, Pa.

[73] Assignee: Philadelphia Suburban Corporation, Bryn Mawr, Pa.

[22] Filed: June 13, 1973

[21] Appl. No.: 369,584

Related U.S. Application Data

[63] Continuation-in-part of Ser. No. 131,763, April 6, 1971, abandoned, and a continuation-in-part of Ser. No. 254,404, May 18, 1972, Pat. No. 3,849,315.

[52] U.S. Cl. ..... 252/3; 252/8.05

[51] Int. Cl.[2] ..... A62D 1/00

[58] Field of Search ..... 252/3, 8.05; 260/501.12

[56] References Cited

UNITED STATES PATENTS

| | | | |
|---|---|---|---|
| 3,429,810 | 2/1969 | White | 252/8.05 X |
| 3,475,333 | 10/1969 | Meldrum et al. | 252/3 |
| 3,531,417 | 9/1970 | Morehouse | 252/312 |
| 3,562,156 | 2/1971 | Francen | 252/3 X |
| 3,621,917 | 11/1971 | Rosen et al. | 252/3 X |

*Primary Examiner*—Benjamin R. Padgett
*Assistant Examiner*—E. Suzanne Parr
*Attorney, Agent, or Firm*—Connolly and Hutz

[57] ABSTRACT

Certain fluorocarbon surfactants combined with certain silicone surfactants provide mixtures that reduce the surface tension of water to 19 dynes or less per centimeter, and when foamed are particularly effective in fighting fires involving lighter-than-water hydrophobic liquids. Mixtures are further improved with certain other surfactants and use less of the fluorocarbon surfactants to provide fire fighting effectiveness of prior art compositions which do not contain silicone surfactants. Hydrophilic resins and sequestering agents can also be contained in the mixtures.

7 Claims, No Drawings

FIRE FIGHTING

The present application is in part of continuation of applications Ser. No. 131,763 filed Apr. 6, 1971 (subsequently abandoned) and Ser. No. 254,404 filed May 18, 1972 (U.S. Pat. No. 3,849,315 granted Nov. 19, 1974).

This invention relates to the fighting of fires with aqueous foam.

When gasoline or similar low density hydrophobic liquids are set afire, special fire-fighting materials are needed. Such fire-fighting materials should be spread very rapidly over the entire surface of the liquid inasmuch as the burning will continue at any location where the burning liquid is not covered. Fire-fighting foams stabilized by fluorocarbon surfactants as described in Tuve U.S. Pat. No. 3,258,423 granted June 28, 1966, or containing fluorocarbon surfactants as in Francen U.S. pat. No. 3,562,156 granted February 9, 1971, are very effective in rapidly spreading over a spill fire.

Among the objectives of the present invention is the provision of improved compositions for fighting such fires.

The foregoing as well as other objectives of the present invention will be more fully understood from the following description of several of its exemplifications to produce a foam, will quickly film over a layer of n-heptane, although the foam is applied to cover only 10% of the layer. The same fluorocarbon surfactant alone dissolved in water at 0.1% concentration and blown with air produces a foam that will not film over an n-heptane layer when applied only on a portion of the layer. Likewise the silicone surfactant alone when applied similarly will not cause film-over. Filming-over or absence of filming-over can be observed by the extinguishment of flames from the burning heptane, or in the absence of burning by illuminating the heptane layer from above and viewing it by the light reflected from the surface. Viewed in this way the aqueous film is clearly distinguishable.

The spreading (filming-over) ability of any given water solution is different for different hydrocarbons. It has been noted for example that hydrocarbons having higher surface tensions and/or a lower content of methyl end-groups are easier to spread over with water films. For example Kerosene, or gasolines having a high content of aromatics, or cyclohexane, are covered with films very readily; but liquids like aviation gasoline, or isooctane (2,2,3-trimethylpentane) or even n-hexane are particularly difficult to film over.

As another illustration a mixture of 80 parts of $(CF_3)_2CF(CF_2)_nCH_2SO_3^-M^+$ where $n$ ranges from 4 to 8 and M is sodium, and 120 parts of

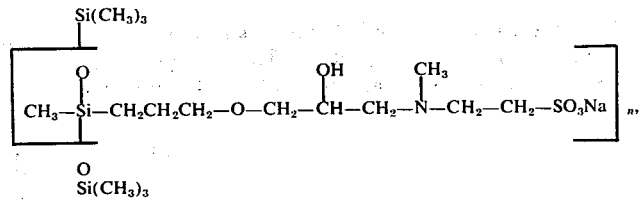

where all proportions are given by weight unless otherwise specified.

When certain fluorocarbon surfactants are mixed with certain silicone surfactants, the mixtures impart to water an unusually striking ability to spread as a film over burning gasoline and the like and thus extinguish all flames. Such mixtures also sharply reduce the surface tension of water as well as the interfacial tension between water and gasoline. The increase in spreadability is generally more effective than produced by either surfactant alone.

For example a mixture of equal parts of

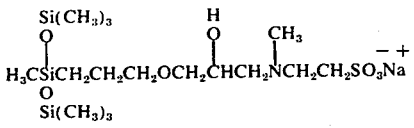

and

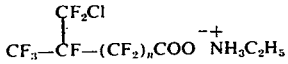

where $n$ ranges from 5 to 9,
when dissolved in water in a combined concentration of 0.1% by weight reduces the surface tension of water at 25°C to the extremely low value of 17.5 dynes per centimeter, a value lower than any obtained when either surfactant is used alone at any concentration. Also the mixture when dissolved in water and blown with air where $n$ ranges from 2 through 5 and averages 3, when dissolved in water in a combined concentration of 0.1% by weight, then foamed and applied over a layer of automotive gasoline will film over rapidly. However neither of the two components alone at the same weight concentration will cause filming-over of the gasoline, nor for that matter will they separately do so at any concentration.

Preferred fluorocarbon surfactants are the salts and amides of perfluorocarboxylic and prefluorosulfonic acids, and amphoteric water-solubilized compounds. These surfactants contain in their structure a hydrophobic and oleophobic perfluorinated or nearly perfluorinated chain of 6 to 15 carbons that is repellant to water and to hydrocarbons. Another part of their structure provides hydrophilic properties and can be of the anionic, cationic, or amphoteric type. Nonionic fluorocarbon surfactants are not as effective regardless of their structure, and are accordingly not preferred. Surfactants containing ester linkages are not desired inasmuch as such linkages hydrolyze on standing in water solution.

The following are typical fluorocarbon surfactants useful for the foregoing purposes;

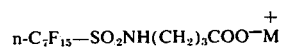

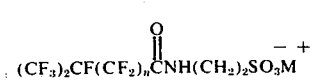

where n is 4 to 13

$(CF_3)_2CF(CF_2)_6\overset{O}{\overset{\|}{C}}NH(CH_2)\overset{O}{\overset{\uparrow}{N}}(CH_3)_2$ $(CF_3)_2CF(CF_2)_7\overset{-}{SO_3}\overset{+}{M}$ $(CH_3)_2CF(CF_2)_3\overset{O}{\overset{\|}{C}}NH(CH_2)_3COO^-\overset{+}{N}H_3C_2H_5$ $(CF_3)_2CF(CF_2)_4COO^-\overset{+}{N}H_3C_2H_5$ $CF_3-\underset{}{\overset{CF_2Cl}{\overset{|}{C}}}F-(CF_2)_8COO^-\overset{+}{N}H_3C_2H_5$ $C_7F_{15}CONH(CH_2)_3\overset{+}{N}(CH_3)_2CH_2CH_2COO^-$ $C_8F_{17}SO_2N(C_2H_5)CH_2COOK$ $CF_3(CF_2)_nCH_2CH_2SCH_2CH_2\overset{CH_3}{\underset{\underset{CH_3}{|}}{\overset{|}{\overset{\oplus}{N}}}}-CH_2COO^{\ominus}$ where n = 5 (55%), 7 (29%) and 9 (balance)

$CF_3(CF_2)_6CH_2CH_2-\underset{\underset{CH_3}{|}}{\overset{|}{\overset{\oplus}{N}}}-CH_2COO^{\ominus}$ M in the formulae stands for an alkali metal or the ammonium radical. Other suitable fluorocarbon surfactants are the anionic, cationic and amphoteric ones described in U.S. Pat. No. 3,475,333 granted Oct. 28, 1969 and in British patent specifications Nos. 1,130,822 published Oct. 16, 1968, and 1,148,486 published Apr. 10, 1969.

Fluorocarbon surfactants in which the fluorocarbon chain is directly linked to a ring such as a benzene ring are not very effective for the purposes of the present invention. The acyclic linking of such a chain to a ring, as by means of a sulfone, methylene or carbonyl group does provide a surfactant that gives good results. The present techniques for producing perfluorocarbon chains tend to simultaneously make chains of varying lengths so that it is less expensive to use a mixture of such chains. The sixth surfactant in the immediately preceding list, for instance, when mixed with analogous compounds in which the $(CF_2)_4$ is replaced by $(CF_2)_3$, $(CF_2)_5$, $(CF_2)_7$ and $(CF_2)_9$ respectively, is a much less expensive material to prepare. An analogous mixture having 6% $CF_2$, about 19% $(CF_2)_3$, about 32% $(CF_2)_5$, about 28% $(CF_2)_7$ and the balance $(CF_2)_9$, makes a very effective fluorocarbon surfactant.

Typical silicone surfactants effective for the above purposes are anionic, amphoteric, or nonionic, have at least one hydrophilic portion linked to a silicone, i.e., Si—O—Si—, structure that is otherwise fully methylated. Such a structure is hydrophobic and oleophilic so that it is repellent to water but attracted to hydrocarbon. Those hydrophilic portions most strongly hydrophilic such as sulfonates, carboxylates, aminosulfonates, and amine oxides, are preferred. The following compounds are additional illustrative silicone surfactants suitable for the foregoing purposes:

$H_3C\overset{Si(CH_3)_3}{\overset{|}{\underset{\underset{Si(CH_3)_3}{|}}{\overset{O}{\overset{|}{\underset{O}{|}}}}}}SiCH_2CH_2CH_2OCH_2\overset{H}{\overset{O}{\overset{|}{C}}}HCH_2\overset{CH_3}{\overset{|}{N}}CH_2CH_2SO_3\overset{-}{N}H_4\overset{+}{}$ $\overset{+}{K}\ \overset{-}{O}_3SCH_2CH_2\overset{CH_3}{\overset{|}{N}}CH_2\overset{OH}{\overset{|}{C}}HCH_2OCH_2CH_2CH_2\overset{CH_3}{\overset{\backslash}{}}\underset{\underset{(CH_3)_3Si}{O}}{Si}\underset{\underset{Si(CH_3)_3}{O}}{\overset{CH_3}{\overset{/}{Si}}}CH_2CH_2CH_2OCH_2\overset{OH}{\overset{|}{C}}HCH_2\overset{CH_3}{\overset{|}{N}}CH_2CH_2SO_3\overset{-}{K}\overset{+}{}$ $(CH_3)_3SiO\overset{CH_3}{\overset{|}{\underset{CH_3}{Si}}}CH_2CH_2CH_2OCH_2\overset{H}{\overset{O}{\overset{|}{C}}}HCH_2\overset{CH_3}{\overset{|}{N}}CH_2CH_2SO_3^-\ Na^+$ $CH_3\overset{OSi(CH_3)_3}{\overset{|}{\underset{OSi(CH_3)_3}{Si}}}CH_2CH_2CH_2OCH_2\overset{OH}{\overset{|}{C}}HCH_2\overset{CH_3}{\overset{|}{N}}CH_2CH_2\overset{O}{\overset{\|}{C}}O^-Na^+$ $(CH_3)_3SiO\overset{Si(CH_3)_3}{\overset{|}{\underset{\underset{Si(CH_3)_3}{O}}{Si}}}CH_2CH_2CH_2OCH_2\overset{H}{\overset{O}{\overset{|}{C}}}HCH_2\overset{CH_3}{\overset{|}{N}}CH_2CH_2SO_3Na$ $[(CH_3)_3SiO]_2Si(CH_3)C_3H_6(OC_2H_4)_3OC_3H_6SO_3Na$ $(CH_3)_3Si-O-\overset{CH_3}{\overset{|}{\underset{CH_2CH_2CH_2OCH_2CH_2OSO_3NH_4}{Si}}}-O-Si-(CH_3)_3$ $CH_3\overset{OSi(CH_3)_3}{\overset{|}{\underset{\underset{Si(CH_3)_3}{O}}{Si}}}CH_2CH_2CH_2(OC_2H_4)_nOCH_2CH_2CH_2SO_3\overset{-}{N}a\overset{+}{}$ (n = 1 to 100)

$CH_3\overset{CH_3}{\overset{|}{\underset{CH_3}{Si}}}-O-\overset{CH_3}{\overset{|}{\underset{CH_3}{Si}}}CH_2CH_2CH_2(OC_2H_4)_nOCH_2CH_2CH_2SO_3\overset{-}{N}a\overset{+}{}$ (n = 1 to 100)

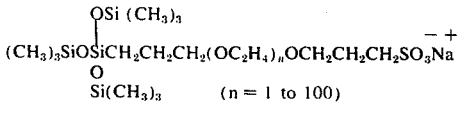

(n = 1 to 100)

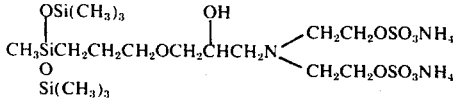

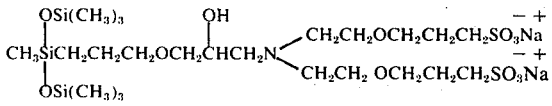

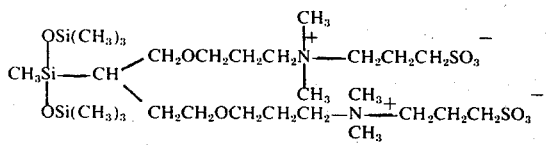

Silicone surfactants tend to hydrolyze when kept for appreciable periods in water solutions that are even slightly acid so that cationic silicone surfactants, which are only effective in acid solutions, are not desired.

Preferred silicone surfactants have a silicone moiety containing two to seven silicons, and one hydrophilic moiety for every one-half to four silicons in the silicone moiety. Where two or more hydrophilic moieties are attached to the same silicon and there is one hydrophilic moiety for every one to one-and-a-half silicons in the silicone moiety, the silicone surfactants are so highly effective that the fluorocarbon surfactant content of the mixture of these two surfactants can be reduced to 7% and still provide highly desirable film formations. The last three silicone surfactants listed above are examples of these highly effective materials.

The surfactants can also be used in mixtures containing two or more fluorocarbon surfactants and/or two or more silicone surfactants, such as when the fluorocarbon surfactant is a mixture having varying lengths of fluorocarbon chain as explained above. In general about 20 to 80% silicone surfactant and 20 to 80% fluorinated surfactant should be present in the mixtures.

The well known acetylenic glycol surfactants added as a third component provide a synergistic increase in filming-over effectiveness as well as a further decrease in surface tension. The acetylenic glycol surfactants can also have their glycol groups condensed with ethyleneoxide.

For example, a mixture of 1 part $$(CH_3)_2CHCH_2C(OH)(CH_3)C \equiv CC(OH)(CH_3)CH_2CH(CH_3)_2$$

2 parts of the first siloxane surfactant listed above, and 3 parts of the last-listed fluorocarbon surfactant, dissolved in water in a combined concentration of 0.1% by weight makes a very effective film-forming and fire extinguishing mixture. It reduces the surface tension of the water at 25°C to 16.6 dynes per centimeter, a value lower than can be obtained by the two latter surfactants in any proportion. In general only about 5 to 50% of the acetylenic glycol surfactant is incorporated in the total mixture of surfactants.

As described on pages 413–14 in the text entitled "Non-Ionic Surfactants" edited by Martin J. Schick and published 1967 by Marcel Dekker, Inc., New York City, the class of acetylenic glycol surfactants includes the above-mentioned ethyleneoxide and polyethylene oxide ether derivatives, and all of them are suitable for synergistic use.

For fire fighting it is desirable to use fluorocarbon surfactants at relatively low concentration, i.e., about 0.05 to 0.15%, preferably 0.1%, in the aqueous solution being foamed. Greater concentrations require excessive surfactant consumption to produce the large quantities of foam needed. However even the aqueos solution itself is awkward to store, so that the standard practice is to only store a concentrate and dilute it with water when the foam is to be made and used. Such concentrates can have 16 to 35 times the surfactant concentration of the diluted solution so that for such use the surfactants of the present invention should have an appropriately high solubility. In general perfluorocarbon chains having a length of over 16 carbons, and siloxanes having more than four silicons per hydrophilic group, too severely restrict the water solubilities of surfactants containing them.

It is important to have the fire-fighting solution applied over the burning liquid in the form of a foam. The foam helps to smother the fire and also provides a reserve of water solution containing the aqueous film-forming ingredients that can spread over the burning surface. The application of unfoamed water solution will merely cause excess solution to drop through to the bottom of the burning liquid because of the density difference, and in this way become incapable of replenishing the aqueous film which is continuously being consumed by evaporation.

At the high dilution at which the filming over feature can still be used for fire-fighting, the fluorocarbon surfactant and silicone surfactant mixtures do not provide good foaming properties, and other standard surfactants which are good foamers and/or foam stabilizers can be incorporated to increase the foaming characteristics. Sodium laurylsulfate and the like are very good for this purpose although they do not contribute to filming-over. Even better for this purpose are the foam-producing surfactants containing a hydrophilic moiety whose weight is at least 80% greater, and more desirable at least 120% greater than that of the lipophilic moiety, as described in U.S. patent application Ser. No. 254,404. These include imidazole surfactants such as:

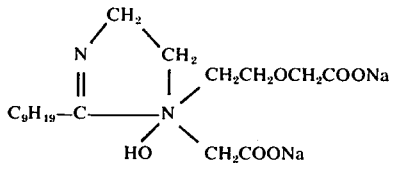

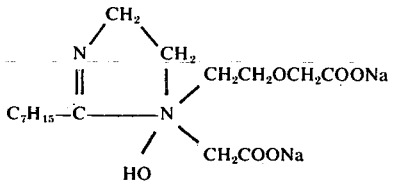

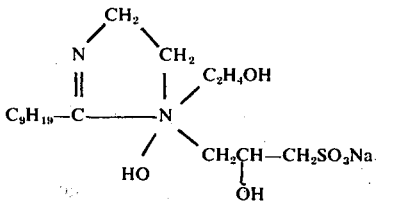

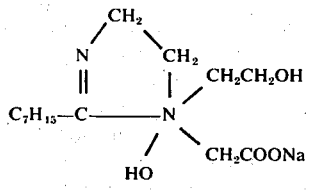

as well as $C_8H_{17}N(CH_2CH_2—COOMe)_2$ where Me is Na or K or mixtures of the two. The following are other exampls of surfactants that upgrade the foam, and any of these or of the foregoing foamers can be used by themselves or in combinations, in a total concentration of about 5 to 200% and even up to 400% of the mixtures of fluorinated and silicone surfactants:

Individual or mixed sodium alcohol sulfates, where the alcohol is a normal primary alcohol having 8 to 20 carbon atoms per molecule Myristyldimethylamine oxide Lauryldimethylamine oxide Sodium laurylethersulfate Ammonium laurylether sulfate Sodium tridecylethersulfate Protein hydrolyzate Surfactants that provide very good foam stability in sea water are also desirable, particularly for concentrates that otherwise show poorer foam stability when diluted with sea water, and yet may be needed for use on shipboard for example, where sea water is the only available diluent. Oleyl alcohol ethoxylate having 20 to 25 ethoxy groups per molecule is a particularly suitable sea water foam stabilizer, as are other heavily ethoxylated surfactants.

Foam-enhancing can also be effected by the addition of a solvent which has the added advantages of helping to release the aqueous film-forming agents from the foam and of providing antifreeze action in cold climate.

The following solvents have been found to be very useful in this way:

| | |
|---|---|
| 2,5-pentanediol | ethylene glycol |
| t-butyl alcohol | 1-butoxyethoxy-propanol-2 |
| isopropyl alcohol | tetraethylene glycol |
| butyl carbitol | 1,2,6-hexanetriol |
| dibutyl carbitol | isobutyl cellosolve |

The fire-fighting effectiveness of the foregoing water solutions further improved by dissolving in them a synthetic or natural hydrophilic resin. About ⅛to ⅓ of such additive based on the combined weight of the fluorocarbon and silicone surfactants, causes the solution to extinguish flames more rapidly, and also more effectively keeps the extinguished liquid from re-igniting. While any natural or synthetic gum such as carraghen or locust bean gum can be used, water-solubilized copolymerization products of maleic anhydride and ethylene or of maleic anhydride carragheen methylvinylether are preferred, particularly where the copolymer is reacted with 3-dimethylaminopropylamine to form a half acid-half amino amide, and thus produce a polyampholyte type structure. Such a material is prepared by taking the ethylene-maleic anhydride polymer described in U.S. Pat. No. 2,396,785 granted Mar. 19, 1946 and gradually adding it in small portions to an equivalent amount of 3-dimethylamino propylamine dissolved in four times its weight of water. The equivalency is based on the reaction of 1 mol of the amine with each anhydride group. Water is also added gradually to keep the reaction mixture stirrable. The mixture is stirred at room temperature for eleven hours after the addition is completed, neutralized with dilute HCl and filtered. The resulting aqueous solution is ready for use. It increases water retention in foams by large amounts as indicated by typical data below:

| | % WATER RETAINED | | |
|---|---|---|---|
| Time, Min. | 5 | 10 | 15 |
| typical foam with 0.2% polymer | 57 | 40 | 32 |
| same foam without polymer | 36 | 21 | 15 |

The resinous copolymers of the types indicated above and shown in U.S. Patent Nos. 3,531,427, 2,378,629 and 3,388,106 granted Sept. 29, 1970, June 19, 1945 and June 11, 1968 respectively can also be used in place of the ethylene-maleic anhydride copolymer referred to above. Preferred copolymers of these types have a monomer ratio of from 40:60 to 60:40.

Polyvinyl pyrrolidones and polyacrylic acids having molecular weights of 500 or more, and the water-soluble salts of the polyacrylic acids, can also be used as hydrophilic gum. Preferred molecular weights of any hydrophilic resin used are above 100,000.

The addition of hydrophilic resins to the fire-fighting concentrates of the present invention also increases the viscosity of the concentrates. This is helpful in assuring more precise proportioning of the concentrates with water, as for instance when using gear-type proportioning pumps such as the Hale Proportioning Water Pump. Thus a concentrate viscosity of about 4 to 6 centistokes may be desired with such pumps. Where the concentrates undergo vigorous agitation during proportioning it is also helpful to have viscosity-increasing additives that do not show the usual thixotropic viscosity drop during such agitation. A portion of the viscosity increase can thus be effected with a dilatant type of additive such as partially hydrolyzed protein or a soluble grade gelatin.

The foregoing foam-forming concentrates are most stable in alkaline condition, and it is accordingly preferred that they be slightly alkaline, that is have a pH at least as high as 7.8. A pH higher than 8 does not further increase the stability and is not desired. The concentrates can also contain buffers that maintain alkalinity even when the concentrates are mixed with other foam-forming concentrates that may be acid. Any compatible buffer or buffer mixture can be used, even sodium bicarbonate, but it is preferred to use tris-hydroxymethyl amino-methane. The amount of buffering should be enough to take care of about 100% addition of an acid foam-forming concentrate which can be considered as having an acid content equivalent of 2 grams of $H_2SO_4$ per liter.

The concentration of fluorocarbon surfactant that produces effective filming can be reduced somewhat when the fire-fighting solution of the present invention contains a small amount, e.g., about 0.003 to 0.01%, of a sequestering agent such as alkali metal salts of nitrilotriacetic acid or of ethylene diamine tetracetic acid.

The following examples of preferred foam-forming concentrates and tests show the results achieved pursuant to the present invention. In Examples I and II fire tests were conducted in a circular pan having a surface area of 33 square feet into which 2 inches of fuel was placed, the fuel lit and permitted to burn as specified (pre-burn time), after which the foamed mixtures were applied at the rate of 0.06 gallons of concentrate per minute per square foot, diluted with additional water as indicated, until the fire was completely extinguished. All times after the pre-burn were measured from the beginning of the foam application. Example IV is particularly suited for use pursuant to the precedure called for by Military Specification MIL-F-23905B(AS) Apr. 25, 1967.

Fire-Extinguishing Liquid Concentrate

| | |
|---|---|
| The second silicone surfactant described in the present specification | 64 g. |
| $(CF_3)_2CF(CF_2)_4COO^- \overset{+}{N}H_3C_2H_5$ | 69 g. |
| $C_{12}H_{25}OC_2H_4OSO_3^- \overset{+}{N}a$ | 80 g. |
| Mixed sodium alcohol sulfates of $C_8$ and $C_{10}$ primary alcohols | 100 g. |
| Ethylene glycol | 250 g. |
| Ethylene-maleic anhydride polymer of Patent 2,396,785 modified with 3-dimethylamino-propylamine as described above. | 20 g. |
| Butyl carbitol | 425 g. |
| Water | to 1 gal. |

Fire Data

| | |
|---|---|
| Fuel | gasoline |
| Pre-burn | 30 seconds |
| Dilution of concentrate | 16⅔ times by volume |
| Foam expansion | 9 |
| Time for foam to cover entire surface | 20 seconds |
| Time for fire to come under control | 45 seconds |
| Time for total extinguishment | 1 minute, 10 seconds |
| Resistance to re-ignition | more than 15 minutes |

EXAMPLE I

Fire-Extinguishing Liquid Concentrate

| | |
|---|---|
| $C_8F_{17}CH_2CH_2SO_2NHCH_2CH_2CH_2COO^- \overset{+}{N}a$ | 63 g. |
| $H_3CSi[O(CH_3)_3]_2CH_2CH_2CH_2OCH_2C(OH)(H)CH_2N(CH_3)CH_2CH_2SO_3Na$ | 36 g. |
| $C_{12}H_{25}OC_2H_4OSO_3^- \overset{+}{N}a$ | 58 g. |
| Sodium octyl sulfate | 72 g. |
| Ethylene glycol | 200 g. |
| Ethylene-maleic anhydride polymer of U.S. Pat. 2,396,785 modified with 3-dimethylamino-propylamine as described above | 16.4 g. |
| Tris(hydroxymethyl)amino methane | 20 g. |
| Butyl carbitol | 200 g. |
| Water | to 1 gal. |

Fire Data

| | |
|---|---|
| Fuel | n-heptane |
| Pre-burn | 1 minute |
| Dilution of concentrate | 16⅔ times by volume |
| Foam expansion | 11½ |
| Time for foam to cover entire surface | 11 seconds |
| Time for fire to come under control | 43 seconds |
| Time for total extinguishment | 1 minute, 58 seconds |
| Resistance to re-ignition | more than 10 minutes |

EXAMPLE II

Fire-Extinguishing Liquid Concentrate

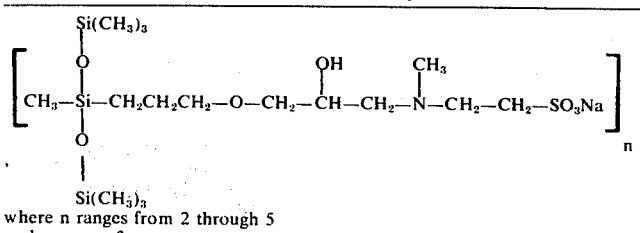

where n ranges from 2 through 5 and averages 3 — 134 g.

-continued

| Fire-Extinguishing Liquid Concentrate | |
|---|---|
| $(CF_3)_2CF(CF_2)_4COO^- \overset{+}{N}H_3C_2H_5$ | 107 g. |
| $(CH_3)_2CHCH_2C(OH)(CH_3)C \equiv CC(OH)(CH_3)CH_2CH(CH_3)_2$ that has been condensed with 30 ethylene oxides | 27 g. |
| Mixed sodium alcohol sulfates of $C_8$ and $C_{10}$ primary alcohols | 1750 g. |
| Dodecyldimethylamine oxide | 20 g. |
| Hexylene glycol | 50 g. |
| Modified polymer of Example I | 22 g. |
| Water | to 1 gal |

| Fire Data | |
|---|---|
| Fuel | gasoline |
| Pre-burn | 30 seconds |
| Dilution of concentrate | 33⅔ times by volume |
| Foam expansion | 10 |
| Time for foam to cover entire surface | 31 seconds |
| Time for fire to come under control | 1 minute, 50 seconds |
| Time for total extinguishment | 3 minutes, 35 seconds |
| Resistance to re-ignition | more than 15 minutes |

The silicone surfactant of Examples I and II is one of the preferred surfactants, although it can be replaced in these examples by any of the other silicone surfactants without much change in the results. Similar results are also produced by the following formulation, to be diluted with 16⅔ times its volume of water when foamed.

EXAMPLE III

| | |
|---|---|
| Eleventh silicone in the above list of thirteen | 81 g. |
| The fluorinated surfactant of Example III | 54 g. |
| Hydrophilic resin produced by treating the copolymer of methyl-vinyl ether and maleic anhydride described in U.S. Patent 3,531,427 with 3-dimethylamino propylamine in exactly the same way as described above for treating the ethylene-maleic anhydride copolymer | 20 g. |
| Dodecyldimethylaminopropane sulfonic acid betaine | 150 g. |
| Water | to 1 gallon |

Omission of the polymer reduces the resistance to re-ignition and slightly delays the first extinguishing times. Omission of the glycols, as in Example III, has no significant effect on the fire extinguishing times or the resistance to re-ignition.

Of special significance are film-forming formulations in which all the surfactants are amphoteric or of amphoteric nature. Thus while the silicone of Example II does not have the classical zwitterion structure, its nitrogens do tend to become protonated and it shows no adverse reaction to quaternary surfactants. It accordingly has an amphoteric nature and when combined with an amphoteric fluorinated surfactant and amphoteric supplemental foamers such as decyldimethylamine oxide or octyldimethylamino propane sulfonic acid betaine, provides a foam-forming concentrate that is compatible with all other foam-forming concentrates. The hydrophilic resin of Example I is also amphoteric and can be added to such an amphoteric type of combination to further improve its fire-fighting effectiveness without detracting from its compatibility. A suitable formulation of this type for dilution to 16⅔ times by volume is:

EXAMPLE IV 110 g. 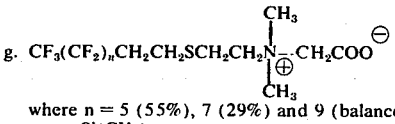 (50% in water)

where n = 5 (55%), 7 (29%) and 9 (balance)

136 g. 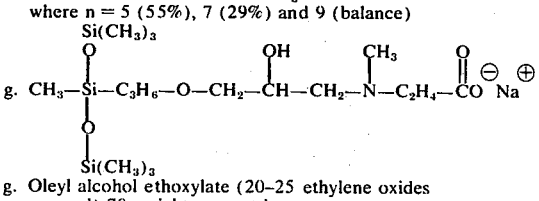 (40% in 1:1 isopropanol-water)

28 g. Oleyl alcohol ethoxylate (20–25 ethylene oxides per mol) 70 weight percent in water 62 g. 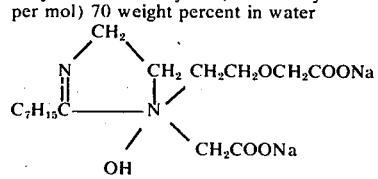

164 g. 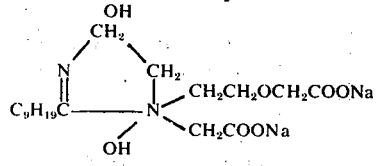

107 g. 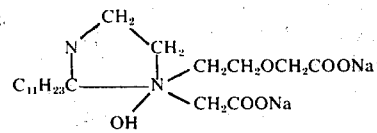

223 g. ethylene glycol
382 g. butyl carbitol
20.4 g. tris (hydroxymethyl)amino methane
22.5 g. polyvinyl pyrrolidone, average molecular weight 360,000
Made up to one gallon with water.

The following formulation is also a very good universal type concentrate that can be mixed with any other commercial concentrate.

EXAMPLE V

| | |
|---|---|
| $C_7F_{15}CONH(CH_2)_3\overset{+}{N}(CH_3)_2CH_2CH_2\overset{-}{COO}$ | 52 g. |
| Silicone surfactant of Example II | 116 g. |
| Decyldimethylamine oxide | 178 g. |
| Octyldimethylamine oxide | 76 g. |
| Octyldimethylamino propane sulfonic acid betaine | 166 g. |
| Dodecyldimethylamino propane sulfonic acid betaine | 60 g. |
| Ethylene glycol | 188 g. |
| Modified polymer of Example I | 20 g. |
| Water | to 1 gallon |

A very effective concentrate for dilution with 33 1/3 times its volume of water, is:

EXAMPLE VI 68 g. $(CF_3)_2CF(CF_2)_nCOO^-\overset{+}{N}H_3C_2H_5$ where n is a mixture of 5 (30%), 7 (30%) and 9 (balance).

157 ml. 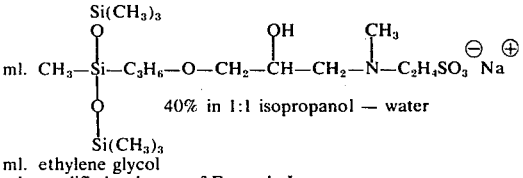

40% in 1:1 isopropanol — water 370 ml. ethylene glycol
378 ml. modified polymer of Example I.
467 ml. of a 30% by weight aqueous solution of about a 1:1 mixture of sodium n-octyl and n-decyl sulfates
467 ml. of a 30% by weight aqueous solution of

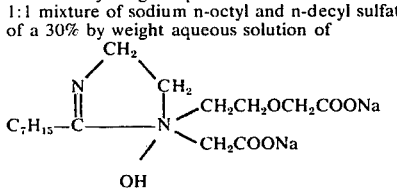

31 g. tris (hydroxymethyl)amino methane
6g. nitrilo-triacetic acid disodium salt
340 ml. butyl carbitol
Dilute to 1 gallon with water and adjust pH to 7.8 with acetic acid. This takes about 29.3 ml. of 1% acid.

Belgian Pat. No. 740,788 said to have been first made available for public inspection on Apr. 1, 1970, refers to fire extinguishing with foams made from aqueous mixtures of a fluorocarbon and silicone surfactant, but the fluorocarbon surfactant of such mixtures is indicated as being insoluble in water and ineffective by itself, although when in a concentration of 0.2% and dispersed with the help of the silicone surfactant, it does produce a fire-fighting foam. This concentration is greater than the maximum fluorocarbon surfactant content in the fire-fighting foams of the present invention, and much greater than the fluorocarbon surfactant content of the foams produced from the working examples of the present application. Moreover this Belgian patent discloses the use of a silicone surfactant in a concentration of 2%, ten times that of the fluorocarbon surfactant, thus further emphasizing the disparity with respect to the present invention.

This can be compared with Example VI of the present invention which has excellent fire-fighting effectiveness and where with the help of a small amount of an amino polycarboxy sequestering agent the concentration of fluorocarbon surfactant in the diluted concentrate as applied to the fire, is less than 0.06%. The sequestering agent content need only be between about one-twelfth to about one-fourth that of the fluorocarbon surfactant for this desirable result.

The heavily ethoxylated foamer surfactant of Example IV can be replaced by other such surfactants having at least about 15 consecutive ethylene oxide units per mol in a single terminal chain and a hydrophobic chain of at least 14 carbons, and in an amount about one-sixth to about equal that of the fluorocarbon surfactant, to give the desired fire-fighting effectiveness after dilution with sea water, using less than 0.09% fluorocarbon surfactant in the diluted material.

In all the working examples given above, the surface tension of the fire-fighting solutions formed is less than 18 dynes/cm., and the solutions rapidly film over burning aviation gasoline.

Obviously many modifications and variations of the present invention are possible in the light of the above teachings. It is, therefore, to be understood that within the scope of the appended claims the invention may be practiced otherwise than as specifically described.

What is claimed:

1. In an aqueous film-forming fire-fighting foamable liquid containing dissolved fluorocarbon and silicone surfactants in amounts that give the liquid a surface tension at least as low as 19 dynes per centimeter but do not give it good foamability and also containing one or more foamability-increasing surfactants that are neither fluorocarbons nor silicones, to bring the foamability of the liquid up to the level needed for a fire-fighting foam, the improvement according to which the fluorocarbon surfactant has the structure

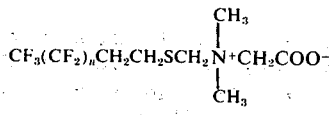

where n is between 5 and 9.

2. The combination of claim 1 in which the silicone surfactant is an anionic substituted tertiary amine.

3. The combination of claim 1 in which the silicone surfactant is a sulfo-trialkylamine.

4. In an aqueous film-forming fire-fighting foamable liquid containing dissolved fluorocarbon and silicone surfactants in amounts that give the liquid a surface tension at least as low as 19 dynes per centimeter but do not give it good foamability and also containing one or more foamability-increasing surfactants that are neither fluorocarbons nor silicones, to bring the foamability of the liquid up to the level needed for a fire-fighting foam, the improvement according to which the liquid also contains an amino polycarboxy sequestering agent in an amount about one-twelfth to about one-fourth that of the fluorocarbon surfactant to reduce the concentration of fluorocarbon surfactant required to effect filming over liquid hydrocarbon.

5. In an aqueous film-forming fire-fighting foamable liquid containing dissolved fluorocarbon and silicone surfactants in amounts that give the liquid a surface tension at least as low as 18 dynes per centimeter but do not give it good foamability and also containing one or more foamability-increasing surfactants that are neither fluorocarbons nor silicones, to bring the foamability of the liquid up to the level needed for a fire-fighting foam, the improvement according to which the foamability-increasing surfactants include alkyl dimethylamino-propane sulfonic acid betaine in which the alkyl is from $C_8$ to $C_{12}$.

6. In an aqueous film-forming fire-fighting foamable liquid containing dissolved fluorocarbon and silicone surfactants in amounts that give the liquid a surface tension at least as low as 19 dynes per centimeter but do not give it good foamability and also containing one or more foamability-increasing surfactants that are neither fluorocarbons nor silicones, to bring the foamability of the liquid up to the level needed for a fire-fighting foam, the improvement according to which the liquid also contains in a concentration of from about one-sixth to about equal that of the fluorocarbon surfactant, of a surfactant having at least about 15 consecutive ethylene oxide units per mol and also having a hydrophobic chain of at least 14 carbons, to improve the fire-fighting effectiveness when the liquid is prepared with sea water.

7. The combination of claim 6 in which the consecutive ethylene oxide units are from about 20 to 25 per mol.

* * * * *

UNITED STATES PATENT AND TRADEMARK OFFICE

CERTIFICATE OF CORRECTION

PATENT NO. : 3,957,657

DATED : May 18, 1976

INVENTOR(S) : Peter J. Chiesa, Jr.

It is certified that error appears in the above-identified patent and that said Letters Patent are hereby corrected as shown below:

Col. 1, in the first line of text, the first occurrence of "of" should be --a--.

Col. 3, in the third structural formula "$(CH_3)_2$" should be -- $(CF_3)_2$ --.

Col. 7, in line numbered 39, "exampls" should be --examples--.

Col. 8, in line numbered 11, --is-- should be inserted after "solutions".

Col. 8, in line numbered 18, "raghen" should be --ragheen--.

Col. 8, in line numbered 20, "carragheen" should be --and--.

Col. 10, all of the fine print between lines numbered 10 30 should be omitted.

Col. 10, in the second structural formula of Example I,

"$[O(CH_3)_3]_2$" should be -- $[OSi(CH_3)_3]_2$ --.

Col. 11, in the third line of text under "Fire Data", "33 2/3" should be --33 1/3--.

Col. 11, line numbered 22, "Examples I and" should be --Example--.

(continued)

UNITED STATES PATENT AND TRADEMARK OFFICE

CERTIFICATE OF CORRECTION

PATENT NO. : 3,957,657

DATED : May 18, 1976

INVENTOR(S) : Peter J. Chiesa, Jr.

It is certified that error appears in the above-identified patent and that said Letters Patent are hereby corrected as shown below:

Col. 11, in the second line of text under the heading "Example III", "III" should be --II--.

Col. 11, line numbered 42, "first" should be --fire--.

Col. 15, in the structural formula in claim 1, "$SCH_2N^+$" should be -- $SCH_2CH_2N^+$ --.

Col. 15, line 32, --from-- should be inserted before "about" (first occurrence).

Signed and Sealed this

Fifth Day of October 1976

[SEAL]

*Attest:*

RUTH C. MASON
*Attesting Officer*

C. MARSHALL DANN
*Commissioner of Patents and Trademarks*